United States Patent [19]

Corriveau

[11] Patent Number: 4,852,470

[45] Date of Patent: Aug. 1, 1989

[54] AIR DISPERSER FOR AIR CONDITIONER/HEATER DUCTS

[76] Inventor: Joseph A. Corriveau, 17339 Wiltshire Blvd., Southfield, Mich. 48076

[21] Appl. No.: 221,370

[22] Filed: Jul. 19, 1988

[51] Int. Cl.[4] ..... F24F 7/06

[52] U.S. Cl. ..... 98/39.1; 98/40.19; 98/101; 98/103; 98/108; 98/114

[58] Field of Search ..... 98/39.1, 40.19, 101, 98/102, 103, 106, 108, 114

[56] References Cited

U.S. PATENT DOCUMENTS

| | | | |
|---|---|---|---|
| 405,092 | 6/1889 | Hood | 98/101 |
| 1,645,140 | 10/1927 | Herbruck | 98/103 X |
| 1,825,423 | 9/1931 | Rottinghaus | 98/108 |
| 1,886,841 | 11/1932 | Searles | 98/101 |
| 2,822,742 | 2/1958 | Ochs et al. | 98/108 X |
| 3,308,746 | 3/1967 | Weiss | 98/108 |
| 4,136,606 | 1/1979 | Wolbrink | 98/108 X |
| 4,589,331 | 5/1986 | Villamagna et al. | 98/101 X |
| 4,754,697 | 7/1988 | Asselbergs | 98/103 |

*Primary Examiner*—Harold Joyce

*Attorney, Agent, or Firm*—Edward D. Gilhooly

[57] ABSTRACT

A device for dispersing cool or warm air from a lower air conditioner/furnace duct. The cool air is transferred to an upper air distribution outlet to provide optimum cooling of a room. The device includes a self-contained powered fan to boost the velocity of cooling air upward to create the desired cooling efficiency. The device is attachable to a wall and may be assembled/disassembled for ease of installation, transport, and storage.

7 Claims, 2 Drawing Sheets

AIR DISPERSER FOR AIR CONDITIONER/HEATER DUCTS

BACKGROUND OF THE INVENTION

1. Field of the Invention

This invention relates to cool and warm air dispersion and, more particularly, to a cool air disperser device for more effectively circulating cool air in a room.

2. Description of the Prior Art

A majority of all heating/cooling systems employed to control temperature in rooms of homes and the like are commonly plagued by the physics of air stratification. The heavier cool air tends to fall to the bottom of the room while during heating the air rises to the top of the room. These affects of cooling or heating can offer temperature discomfort from both the standpoint of air distribution and vertical temperature differentials in the room. This problem is particularly encountered in dwellings having a heating/cooling system in which the air ducts are situated near the floor of the room. With such lower ducts, the cool air from the air conditioner generally stratifies in the lower portion of the room and efficient cooling circulation is virtually impossible.

Devices for diverting the flow of air from ducts have been introduced in the past, but known venting devices have failed to provide optimum cooling from a furnace or air conditioner outlet positioned near the floor. Moreover, prior designs of such articles do not effectively operate for cooling and heating, and the past devices must be removed during the Summer season. One prior ventilator unit is disclosed in U.S. Pat. No. 4,481,871 to E. Efstratis issued Nov. 13, 1984. The device disclosed in the foregoing Efstratis patent is simply ane extension in the form of a conduit having no air transfer device to increase the cooling circulation of air in a room. A similarly limited ventilation extension unit is disclosed in U.S. Pat. No. 4,020,753 to E. Efstratis issued May 3, 1977. Some ventilators have used air fans to supplement the transfer of heat, such as shown in U.S. Pat. Nos. 4,534,276 issued to A. Allison and 4,136,606 issued to Wolbrink on Jan. 30, 1979, but the devices described in the foregoing two patents are not concerned with cooling nor are connected to a furnace outlet for efficiency. Finally, U.S. Pat. Nos. 4,353,411 issued Oct. 12, 1982 and 4,214,706 issued July 29, 1980 are directed to relatively complex structures not having a practical use in the efficient and inexpensive dispersion of cool air in a residence. Moreover, none of the devices disclosed in the patents herein disclosed are capable of efficient operation during both cooling and heating, even if permanently installed, provide an attractive appearance in the room and are easily installed, removed and transported.

SUMMARY OF THE INVENTION

It is an objective of the invention to provide an effective and inexpensive air disperser for increasing the temperature comfort in a room, particularly in situations where the furnace ducts are situated near the floor as in many heating/cooling systems. The device herein disclosed may be detachably affixed to furnace air outlet and to the wall of the room for ease of attachment and removal, or where desired, permanently installed. A fan means is operatively installed within the invention to boost the flow of cool air upward near the top of the room for better cooling efficiency. The booster fan raises cool air circulation to a upper air outlet to increase the effective area of cooling in the room as well as reducing the load on the furnace or air conditioner blower during cooling for more economical operation of the entire system. In addition, a lower vent is provided as an option to allow selected egress of warm air at the floor level, a feature particularly desirable if the unit of the invention is permanently installed.

DESCRIPTION OF THE PREFERRED EMBODIMENTS

Figure 1:
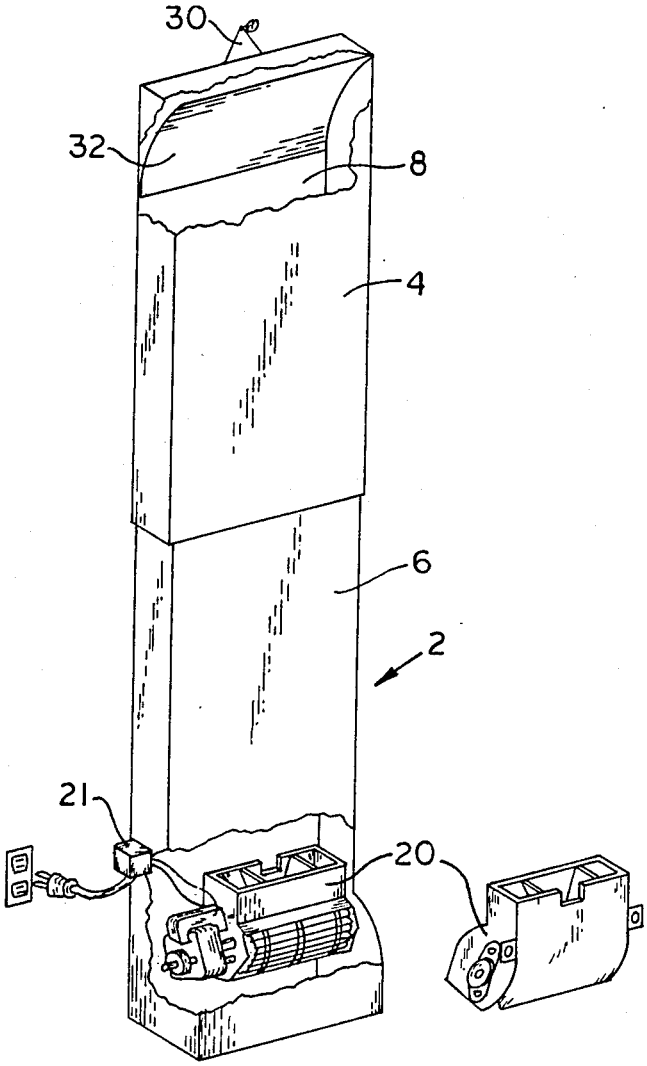
FIG. 1 is a front perspective view, with parts cut away, of the air disperser of the invention mounted on a wall adjacent a furnace duct.
Figure 2:
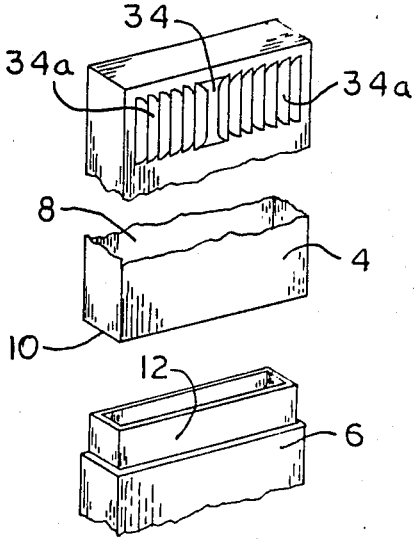
FIG. 2 is a partial front perspective view with parts cut away and in unassembled form showing the vertical conduit of the air disperser of FIG. 1.

Referring now to FIGS. 1–4, there is illustrated an embodiment of the air disperser of the invention, generally designated by reference numeral 2. Air disperser 2 is constructed with a upper hollow housing 4 and a lower hollow housing 6, both fabricated from a metal or other suitable materail. The housings 4 and 6 have a rectangular cross sectional configuration and form an internal flow passage 8 extending from the bottom to the top of the unit. As best seen in FIG. 2, the lower portion 10 of upper housing 4 detachably interfits over a narrow upper end portion 12 of lower housing 6 so that the two sections may interfit together as a unit.

Figure 3:
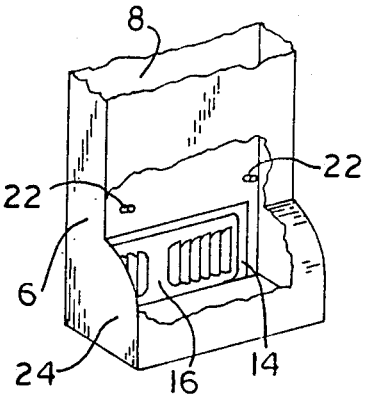
FIG. 3 is a partial front perspective view, with the fan removed, of the lower portion of the air disperser of FIG. 1 mounted adjacent the outlet of a furnace positioned near the floor.
Figure 4:
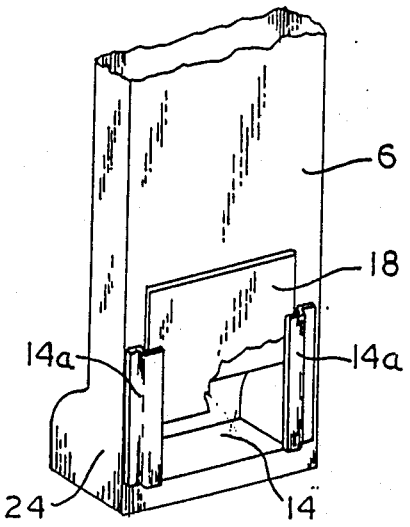
FIG. 4 is a partial rear perspective view of the base of the air disperser of FIG. 1.

As further seen in FIG. 4, the back of the lower housing 6 includes a lower air outlet opening 14 that is positioned in attached relationship with furnace/air conditioner air outlet 16 in the wall (FIG. 3). The lower housing 6 includes a pair of Velcro strips **14*a* that may be attached to the wall having corresponding Velcro strips (not shown) to affix the housing 6 to the wall adjacent to furnace outlet 16. A slidable panel 18 mounted beneath strips 14*a* or by any other suitable means is adjustably moveable over housing opening 14 relative to furnace air outlet 16 to match the size of housing opening 14 with the furnace outlet 16 as seen in FIG. 4. Lower opening 14 and the adjacent portions of housing 6 are pressed against furnace outlet 16** during mounting.

As further shown in FIGS. 1 and 3, an air transfer device 20, such as a conventional squirrel cage fan powered by an electrical motor, is mounted within lower housing 6 immediately above the furnace air outlet 16. The fan 20 can be a constant rotating type, or a variable device having its output controlled by a local or remote speed control 21, or a thermostat, all of conventional designs. An automatic on/off switch (not shown) may be operatively connected to the fan motor to cut off the fan 20 in absence of cool air coming from the furnace air outlet 16 and reactivating the fan motor in the presence of cool air flow. The shut-of switch may be of any type of flow activated device, such as one having a deflectable vane (not shown) disposed in the flow path adjacent housing opening 14. The housing 6 may be provided with threaded members 22 (FIG. 3) to attach the fan 20 to the housing 6. The bottom of lower housing 6 has an expanded base portion 24 to accommondate the fan internally. The base portion 24 may be detachably affixed to the rest of housing 6 by any suitable technique, such as the manner by which housing 4 and 6 interfit in FIG. 2.

The housing 4 includes a bracket 30 which can be attached to a hook, nail, or the like affixed to the wall. In some situations, the air disperser 2 may be permanently attached to both the furnace outlet 16 and the wall by any conventional technique for a permanent installation. As seen in FIG. 1, the upper portion of housing 4 includes a curved panel 32 to direct air flow outward through duct 34 mounted at the top of the housing 4 as illustrated in FIG. 2. The duct is fitted with adjustable louvers 34*a* that control the flow of cool air or may be closed during heating.

In operation, the flow of cool air from furnace outlet duct 16 from the central air conditioning unit is directed through the fan 20. The fan 20 boosts the velocity of flow of cool air for dispersement out the upper vent 34. The effect of the fan 20 raising the velocity of air reduces air stratification and increases cooling circulation from the top portion of the room even when a lower furnace duct is present. The fan 20 also reduces the load on the furnace blower to the extent that its output may be reduced for greater efficency.

Figure 5:
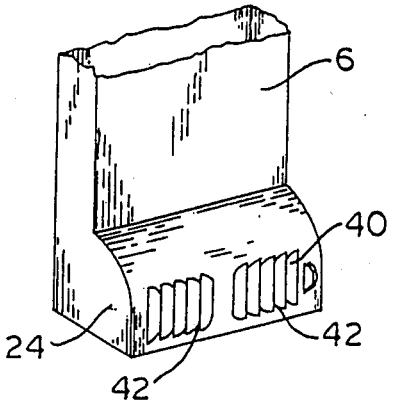
FIG. 5 is a front perspective view of the air disperser of FIG. 1 having a front warm air vent.

Referring now to FIG. 5, there is illustrated a modification of the air disperser 2 of the invention. The base portion 24 is provided with a front heater vent 40 having adjustable louvers 42. The louvers 42 are closed to block air flow during cooling, but opened during heating to permit heat to be distributed to the room through the lower louvers 42 for better heating efficiency. The auxiliary heater duct 40 is particularly useful when the air disperser 2 is permanently installed on the wall. Since the fan 20 is mounted above at least a portion of the opening 14 and does not adversely disturb the flow of air, heat from the furnace outlet may be directed outward into the room from louvers 42. In the heating mode, upper louvers 34*a* are closed and the fan 20 is turned off.

Figure 6:
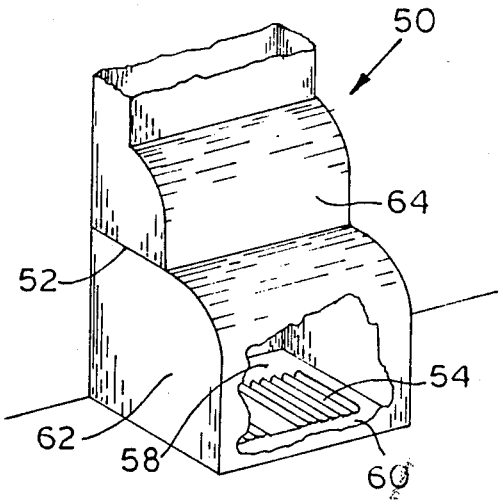
FIG. 6 is a partial front perspective view of a second embodiment of the air disperser of the invention having a modified base for attachment to a furnace air outlet located on the floor.
Figure 7:
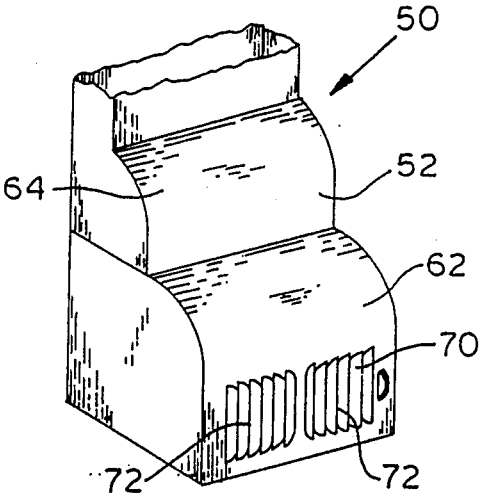
FIG. 7 is a partial front perspective view of the air disperser of FIG. 6 having an warm air outlet.

In FIG. 6 and 7 a second embodiment of the air disperser of the invention is shown as air disperser 50. Air disperser 50 is identical to the preceding embodiment shown in FIG. 1, except that the base 52 is modified to accommodate furnace floor vents, such as air outlet 54, often found in heating systems. An opening 58 is formed in floor 60 in an enlarged bottom portion 62 of the base 52. A fan (not shown) is positioned in an upper section 64 of the base 52 to boost the velocity of cool air upward as in the preceding embodiment. The floor 58 of the bottom housing portion 62 is affixed to the floor of the room adjacent to opening 58 by any suitable technique, such as by Velcro strips similar as previously described herein. As seen in FIG. 7 the front of bottom housing portion 62 may be fitted with a second air outlet 70 having louvers 72 for heating in the same manner as the modification to air disperser 20 described with reference to FIG. 5.

What is claimed is:

1. An air disperser for attachment to the air outlet delivering cool and warm air to a room comprising housing means having an elongated internal flow passage, said housing means being arranged to be positioned with said internal flow passage being oriented along a vertical axis, said housing means forming a lower opening for receiving air flow from an air outlet disposed in a lower portion of the room and delivering cool or warm air to the room, attachment means for affixing the housing means against a wall or floor of the room with said lower opening in alignment with the air outlet, said housing means further having a upper vent opening mounted in an upper portion of the room above said lower opening for dispersing cool air into the room, and fan means positioned above at least a portion of said air outlet in said flow passage for boosting the velocity of cool air in an upward direction for directing the cool air to said upper vent opening for dispersion into a upper portion of the room.

2. The air disperser according to claim 1 wherein said housing means includes an upper portion and a lower portion, means for detaching said lower portion from said upper portion for disassembly of said housing means.

3. The air disperser according to claim 1 further including a heat outlet formed in a lower portion of said housing means in opposed relationship to said air outlet, said heat outlet having louvers being adjustable from a closed position to prevent cool air flow through said heat outlet and to an open position to permit warm air flow from said heat outlet.

4. The air disperser according to claim 3 further including adjustable louvers mounted at said upper vent opening, said louvers being adjustable from an open position during the flow of cool air from said air outlet to a closed position during the flow of warm from said air outlet.

5. The air disperser according to claim 2 further including a panel being affixed to said housing means adjacent said lower opening, attachment means for affixing said panel to said housing and permitting sliding movement of the panel adjacent said lower opening to match the size of said lower opening to the size of said air outlet.

6. The air disperser according to claim 5 wherein said housing means includes a upper bracket means for attaching an upper portion of of said housing means to a wall of the room.

7. The air disperser according to claim 1 wherein said fan means is positioned in said internal flow passage above said lower opening for permitting the flow of heat from said air outlet under said fan means, a heat outlet mounted on said housing means beneath said fan means for directing the flow of heat from said heat outlet to the room, said fan means being disengaged during the flow of heat through said heat outlet.

* * * * *